US007157202B1

(12) United States Patent
Crichton et al.

(10) Patent No.: US 7,157,202 B1
(45) Date of Patent: Jan. 2, 2007

(54) METHOD AND APPARATUS FOR REDUCING DENSIFICATION OF MULTIPLE COMPONENT ELECTROGRAPHIC DEVELOPER

(75) Inventors: John F. Crichton, Honeoye Falls, NY (US); Thomas M. Plutchak, Hilton, NY (US); Jeffrey S. Baker, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 175 days.

(21) Appl. No.: 10/669,078

(22) Filed: Sep. 23, 2003

Related U.S. Application Data

(60) Provisional application No. 60/413,902, filed on Sep. 26, 2002.

(51) Int. Cl.
*G03G 9/083* (2006.01)

(52) U.S. Cl. ..... 430/137.21

(58) Field of Classification Search ..... 399/12; 430/106.1, 137.21
See application file for complete search history.

(56) References Cited

U.S. PATENT DOCUMENTS 4,027,621 A * 6/1977 Kane et al. ..... 118/667
4,546,060 A 10/1985 Miskinis et al.
4,634,286 A 1/1987 Pike
4,671,207 A 6/1987 Hilbert
4,887,132 A 12/1989 Joseph et al.
5,146,277 A 9/1992 Fox et al.
5,339,140 A 8/1994 Zeman et al.
5,512,406 A * 4/1996 Takeda et al. ..... 430/110.4
5,640,656 A 6/1997 Hilbert et al.
5,862,433 A 1/1999 Regelsberger et al.
5,890,033 A * 3/1999 Parker ..... 399/94
5,937,229 A 8/1999 Walgrove et al.
5,987,271 A 11/1999 Regelsberger et al.
6,121,986 A 9/2000 Regelsberger et al.
6,589,703 B1 7/2003 Stelter et al.
6,610,451 B1 8/2003 Jadwin et al.
6,766,136 B1 * 7/2004 Jadwin et al. ..... 399/267
2003/0091922 A1 * 5/2003 Okado et al. ..... 430/111.33
2003/0224279 A1 * 12/2003 Kotsugai et al. ..... 430/111.1

* cited by examiner

*Primary Examiner*—John L Goodrow
(74) *Attorney, Agent, or Firm*—Donna P. Suchy

(57) ABSTRACT

The invention relates to the field of two component magnetic brush development of electrographic images. According to one aspect of the invention, a method of processing a developer is provided for developing an electrostatic image wherein a set developer is exercised with a blender prior to using the developer for developing the electrostatic image. According to a further aspect of the invention, the developer comprises ferromagnetic toner and hard magnetic carriers.

11 Claims, 2 Drawing Sheets

METHOD AND APPARATUS FOR REDUCING DENSIFICATION OF MULTIPLE COMPONENT ELECTROGRAPHIC DEVELOPER

BACKROUND

The invention relates to the field of two component magnetic brush development of electrographic images.

In dual component electrophotographic toning systems, the developer, which contains a mixture of both toner and carrier particles, must flow freely with the ability to make toner available to the electrostatic image. In existing systems, during normal operation of electrostatic image development, the developer mix is continually exercised and aerated by mechanical blenders in the developer sump. When operation of the equipment ceases for a time, for example overnight, the developer settles and loses aeration. Loss of aeration can cause a developer flow more like wet cement, with variable density throughout the developer mass, rather than a flow of a light, dry powder. With most dual component developers this condition is fleeting and the developer mix is quickly aerated with exercise on startup.

There are situations where the developer takes a long time to aerate properly. One example involves surface treated toners. Toners may be surface treated to improve their flow properties within a toner bottle and through a toner replenishment station. In general, a developer mix implementing surface treated toner has more of a tendency to pack during a rest period than a developer mix implementing non-surface treated toner, particularly if subjected to vibration. A developer mix implementing surface treated toner generally takes more time to aerate to an acceptable level for satisfactory electrographic image development. Surface treated toners are disclosed in United States Patent Publication Number US-2001-0055723-A1, published Dec. 27, 2001, the contents of which are incorporated by reference as if fully set forth herein.

A toner monitor is often used to sense the amount of toner present in a developer mix. A commonly used toner monitor senses the presence or absence of ferromagnetic material in its field of view. The toner monitor/replenishment control interprets the greater developer density caused by developer packing as a low toner condition. Potentially large amounts of toner are added to correct this condition, which can result in image quality defects such as broad lines, heavy density, and background toning in the resultant prints. Alternatively, the toner monitor/replenishment control may sense a toner concentration outside the machine parameters, and cause machine lockout. Regardless, toner concentration may change in relation to the changing developer state of aeration, creating an unstable or ill-defined state of electrographic development. An electrogaphic control system that implements a toner monitor and toner replenishment similar to that implemented in the present invention is disclosed in U.S. Pat. No. 5,987,271.

Toner for Magnetic Ink Character Recognition (MICR) may exhibit exacerbated packing tendencies, particularly when mixed with magnetic carrier particles. A developer that implements magnetic carrier particles for enhanced electrographic image development is described in U.S. Pat. No. 4,546,060 in the names of Jadwin and Miskinis, the teachings of which are fully incorporated by reference as if set forth herein. Degraded flow may extend for a long period of time before the toner is loosened enough to provide good developer flow and toner monitor behavior. In this case, the densification associated with a surface treated toner is exacerbated by the magnetic attraction of the toner and carrier. By sitting in what can be described as a "magnetic bath" the toner and carrier can become closely spaced to the point where a great deal of agitation or other energy needs to be applied to make the toner available to the image and the developer density low enough to be in the toner monitor's acceptable range. Magnetic toners are disclosed in United States Patent Publication Number US-2002-0115006-A1, published Aug. 22, 2002, the contents of which are incorporated by reference as if fully set forth herein. Toners implemented in MICR applications are ferromagnetic.

SUMMARY OF THE INVENTION

According to one aspect of the invention, a method of processing a developer is provided for developing an electrostatic image, comprising exercising a set developer with a blender prior to using the developer for developing the electrostatic image. According to a further aspect of the invention, the developer comprises ferromagnetic toner and hard magnetic carriers.

DESCRIPTION

Figure 1:
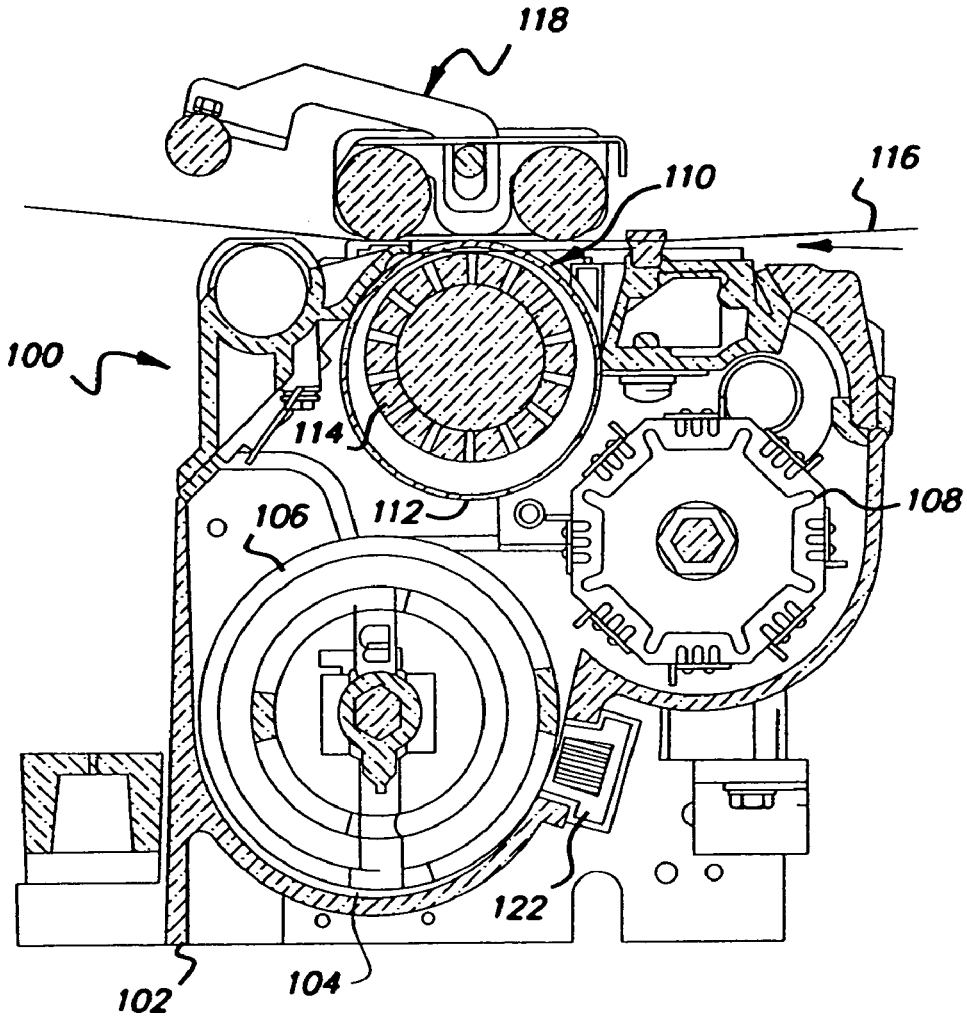
FIG. 1 presents a cross-sectional view of a toning station implemented according to one aspect of the present invention.

Various aspects of the invention will now be described with reference to FIG. 1, which is not drawn to any particular scale. FIG. 1 presents a cross sectional view of a toning station 100 implemented according to one practice of the present invention. Toning station comprises a housing 102 that defines a developer sump 104 containing a developer (not shown) that is a mixture of toner and hard magnetic carriers of a type described in U.S. Pat. No. 4,546,060. A ribbon blender 106 is rotated in the sump 104. The ribbon blender 106 mixes and agitates the developer keeping it well mixed and also promoting tribocharging of the carrier and toner particles constituting the developer. The ribbon blender 106 may be of a type described in U.S. Pat. Nos. 4,634,286 and 5,146,277. A developer feed mechanism 108 lifts developer from the sump 104 to a magnetic brush 110. The magnetic brush is of a type described in U.S. Pat. No. 4,546,060 and comprises a toning shell 112 configured to rotate, and a core 114 having a plurality of magnets of alternating polarity that upon rotation of the core 114 cause the carrier particles to rotate in an opposite direction in an advancing nap coating the toning shell 112, as is well known in the art. The toning shell 112 may be rotated to contribute to the motion of the nap, again, as is well known in the art.

The advancing nap (not shown), constituting a magnetic brush, contacts a photoconductor 116 having a latent electrostatic image and toner is attracted from the magnetic brush (developer) to the photoconductor 116 as it is advanced over the magnetic brush, thereby developing the image thereon. A backer bar 118 retains the photoconductor 116 in proper position relative to the toning shell, and in contact with the magnetic brush. The developer falls back into the sump 104.

The magnetic brush operates according to the principles described in U.S. Pat. No. 4,546,060, the contents of which are fully incorporated by reference as if set forth herein. The two-component dry developer composition of U.S. Pat. No. 4,546,060 comprises charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. As described in the '060 patent, the developer is employed in combination with a magnetic applicator comprising a rotatable magnetic core and an outer, nonmagnetizable shell to develop electrostatic images. When hard magnetic carrier particles are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the '060 flow smoothly and at a rapid rate around the shell while the core rotates in the opposite direction, thus rapidly delivering fresh toner to the photoconductor and facilitating high-volume copy and printer applications.

A toner replenisher 120 adds toner to the developer in response to a control system, generally according to depletion of toner from the developer in the sump 104, as sensed by a toner monitor 122. The replenisher may take a variety of configurations, including a perforated tube connected to an attendant mechanism that feeds toner from a toner bottle. The particular configuration of the mechanism is not critical in the practice of the invention.

Numerous parameters may be sensed and controlled that effect the development of the electrostatic image on the photoconductor 116. Generally a control system is implemented to sense and control such parameters. The control system may be of the type described in U.S. Pat. Nos. 5,862,433, 5,937,229, 5,987,271, 6,121,986. Of particular interest here is the type of control system that implements a range of toner monitor readings that are considered acceptable. Readings outside of that acceptable range are interpreted as indications of a more serious malfunction, and the marking engine is locked-out in order to avoid damage to some component. Examples include toner monitor reading toner levels that are greater or less than the acceptable range.

The present invention focuses more specifically upon ferromagnetic toner, and problems in the control of printing with such toner, as described in the Background section. More particularly, the present invention addresses problems attendant with attaining and maintaining good flow characteristics of developer having ferromagnetic toner, especially after such developer remains in a stagnant unused state for a period of time sufficient to cause the developer to set. As used herein, the term "set" means that internal forces tend to cause the developer to adhere to itself such that it does not have suitable flow properties, for example after mixing by a blender that would render acceptable flow in a developer comprising non-ferromagnetic toner and hard magnetic carriers. As used herein, "exercising" or "exercise cycle" means a pre-imaging blending cycle implemented to place the developer in proper condition for image development. The present invention is also concerned with avoiding print engine lockout due to toner monitor readings outside an acceptable range, and further aspects evident from the description presented herein.

According to one aspect of the invention, a method of processing a developer for developing an electrostatic image is provided comprising exercising a set developer with a blender 106 prior to using said developer for developing the electrostatic image, the developer comprising ferromagnetic toner and hard magnetic carriers.

As discussed in the Background section, clumping of set developer in the sump can cause the control system to sense a low toner state that is outside an acceptable operating range and to lock-out the print engine in response. According to another aspect of the invention, this is avoided by adding a relatively small amount of the ferromagnetic toner at the start of the exercising cycle. The additional toner has the effect of dropping the toner monitor's output immediately. This alone may move the toner monitor output to a range wherein the print engine will not shut down for low toner. The toner may be added before or during the exercising cycle.

In our testing, the toner monitor responded to a small toner addition, on the order of 0.1 to 1.0% by weight of the developer mass, in a manner commensurate with the sensitivity of the toner monitor. A toner addition on the order of 0.5% may be implemented. While larger amounts of toner can bring the toner monitor output to its normal level even quicker, this larger amount of toner may significantly change the toner concentration of the developer resulting in image quality defects. For example, 2300 grams of MICR developer allowed to sit overnight exhibited a toner monitor reading of about 3.2 volts during an exercise cycle. With the same conditions, an addition of 23 grams of toner at the beginning of the exercise cycle produced a toner monitor reading of about 2.6 volts. With a Hitachi toner monitor (part numbers 8C9216 and 6C3389), the control setpoints are 2.5+/−0.6 Volts, wherein a high reading indicates too little toner, and a low reading indicates too much toner. Exceeding either limit generates a printer error, and may cause a lock-out that disables further printing pending service by a field engineer.

According to a further aspect of the invention, warming the toning station 100 has an effect similar to the addition of toner. Warming the developer also removes accumulated moisture from the developer, which tends to improve flow characteristics. The toning station 100 may be warmed as long as the action of warming the station does not induce fusing or sintering of the toner in the toning station. As a cool toning station 100 is warmed, preferably to a normal operating temperature (a steady state temperature attained due to mechanical agitation, eddy current heating, friction, or general machine warm-up), the toner monitor output lowers even without any toner addition. This works well for toning stations which have been outside of the printer and have approximated the environment in which they have been sitting. Warming the toning station along with exercise helps bring the toner monitor output within the operating range. For example, 2300 grams of MICR developer allowed to sit overnight exhibited a toner monitor reading of about 3.2 volts during an exercise cycle. With the same conditions, warming developer to approximately 88 degrees Fahrenheit prior to beginning of the exercise cycle produced a toner monitor reading of about 2.8 volts.

According to a preferred embodiment, adding toner at the start of the exercise cycle and warming the toning station are used together.

Figure 2:
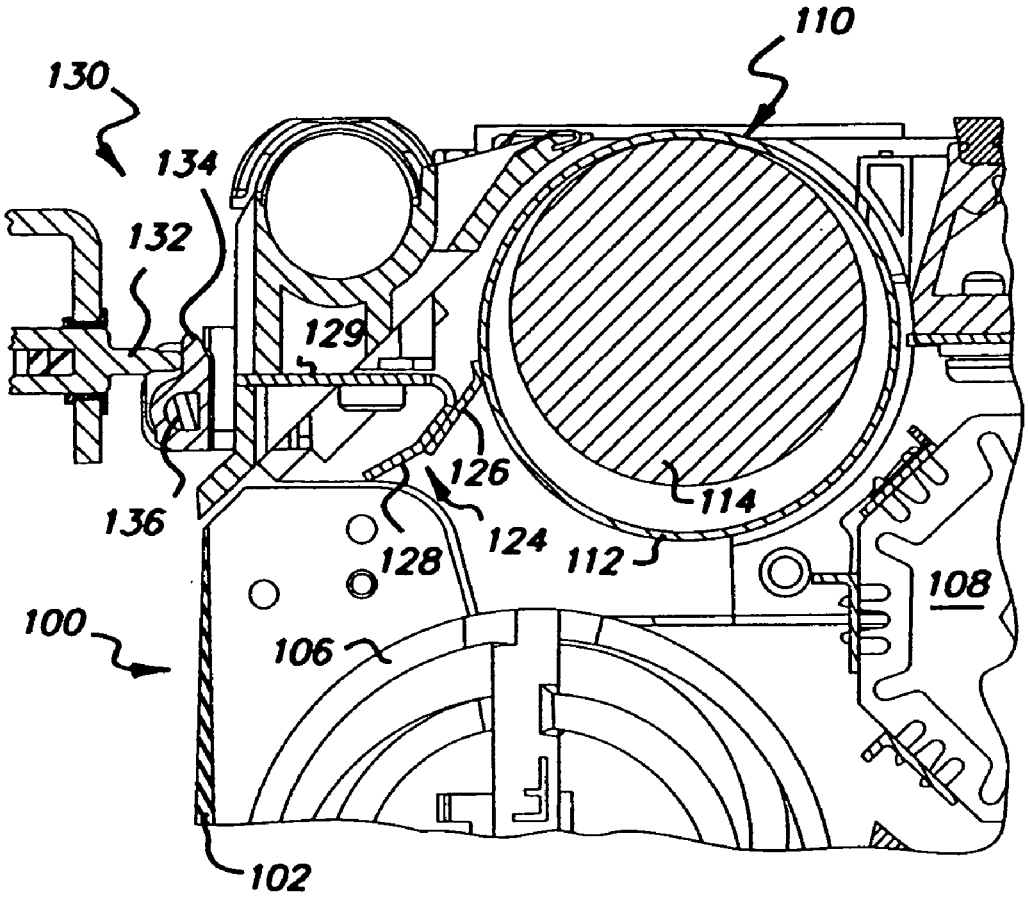
FIG. 2 an enlarged cross sectional view of a portion of the toning station of FIG. 1 is presented, with a positionable blade.

In addition to the two techniques described above, according to a further aspect of the invention with reference to FIG. 2, removing agitated developer from the toning shell 112 with a blade 124 downstream from the developer/film interface is another technique which may be used. Examples of blades are disclosed in U.S. Pat. Nos. 4,671,207, 4,887,132, 5,339,140, and 5,862,433. According to a preferred embodiment, the blade 124 comprises a pliable strip 126, for example polyurethane, mounted to a rigid backing 128. As the developer is run over the toning shell 112, it is agitated by rotating magnetic poles in the core 114, becoming less dense by this action. With a strongly magnetic toner such as is used for MICR printing, much of the developer that should fall off after passing through the developer/photoconductor interface actually continues to stay on the surface of the toning shell 112 and does not mix with the developer in the sump 104 to reduce the densification there. By removing all or part of this agitated developer off the toning shell 112 during the early exercise cycle, the lower density agitated developer mixes with the developer in the sump 104, lowering the overall developer density. Lower developer density translates directly to lower toner monitor output, approaching that of the fully "fluffed" operational developer.

Since a blade riding against the toning shell 112 may generate frictional heating and toner flakes over time, it may be desirable to avoid engaging the blade against the toning shell 106 while still removing developer by placing the blade 124 proximate the toning shell 106 but not in contact with it. Alternatively, the blade 124 may be engaged against the surface of the toning shell 106 only during a portion of the exercise cycle and again periodically for short times. For example, the blade 124 may be engaged against the toning shell 112 at a beginning portion of the exercising, and disengaged from the toning shell 112 at a conclusion of the beginning portion. Still referring to FIG. 2, an enlarged cross sectional view of a portion of the toning station 100 is presented, with a positionable blade 124. As presented in FIG. 2, the blade 124 may be positioned against the surface of the toning shell 106. A positioning mechanism 130 positions the blade 124, and comprises a plunger 132, a cam 134, and a camshaft 136. The cam 134 is mounted on the camshaft 136, and the plunger 132 is driven into the cam 134 by an actuator (solenoid, for example), which causes the camshaft 136 to rotate around the camshaft 136. A portion 129 of the rigid backing 128 extends through a perforation in the housing 102, and the camshaft 136 encounters this portion 129 thereby driving the blade assembly 124 toward the toning shell 112. With a lesser actuation, the blade assembly 124 is displaced toward the toning shell 112 without actually contacting the shell, which may be desirable since the blade assembly 124 still removes developer from the toning shell 112 without actually contacting the toning shell 112.

According to a particularly preferred embodiment, all three techniques, i.e. adding toner, warming the toning station, and removing the agitated developer, are combined and with exercise provides the greatest flexibility of use and quickest return of the developer to "fluffed" density and normal toner monitor behavior.

Tests were performed from 1 minute to 30 minutes for fluffing time. In a certain embodiment 90 seconds of fluffing time is followed by the normal process control set-up which is used by a printer, for example the Digimaster® 9110 printer manufactured by Heidelberg Digital L.L.C. of Rochester, N.Y. This normal process control set-up contains one minute of exercise followed by a density patch creation and set-up of the development process voltages and toner concentration. In essence, there is 2½ minutes of exercise (1½ minutes fluff+normal process control set-up) before actually sensing the toner monitor voltage for toner concentration adjustment. Tests have shown that material density improves very slowly after the initial 90 seconds, so a preferred range is about 80 to 100 seconds of fluff before the process control set-up. The blade 126 preferably engages the toning shell 112 during the fluff period.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A method of processing a developer, including ferromagnetic toner and hard magnetic carriers, for developing an electrostatic image, comprising:

heating a set developer, adding a relatively small amount of ferromagnetic toner to said set developer, and exercising said set developer with a magnetic brush and a blender prior to using said developer for developing said electrostatic image, while removing developer from a toning shell for transporting developer for developing said electrostatic image.

2. The method of processing a developer of claim 1, wherein said developer is heated to a normal operating temperature.

3. The method of processing a developer of claim 1, wherein said added amount of ferromagnetic toner is on the order of 0.1 to 1.0% by weight of said developer mass.

4. The method of processing a developer of claim 1, wherein said added amount of ferromagnetic toner is on the order of 0.5%.

5. A method of processing a developer, including ferromagnetic toner and hard magnetic carriers, comprising:

exercising a fully developed, set developer in a pre-imaging blending cycle with a magnetic brush and a blender while simultaneously heating the developer.

6. The method of processing a developer of claim 5, wherein said developer is heated to a normal operating temperature.

7. The method of processing a developer of claim 5, further adding a relatively small amount of ferromagnetic toner to the developer.

8. The method of processing a developer of claim 7, wherein the added amount of ferromagnetic toner is on the order of 0.1 to 1.0% by weight of said developer mass.

9. The method of processing a developer of claim 7, wherein the added amount of ferromagnetic toner is on the order of 0.5% by weight of said developer mass.

10. The method of processing a developer of claim 7, wherein said adding said amount of ferromagnetic toner takes place before said exercising of said set developer.

11. The method of processing a developer of claim 7, wherein said adding said amount of ferromagnetic toner takes place during said exercising of said set developer.

* * * * *